US008439459B2

(12) United States Patent
Johnson

(10) Patent No.: US 8,439,459 B2
(45) Date of Patent: May 14, 2013

(54) APPARATUS FOR LATCHING A DRAWER USING A CAM LATCH

(75) Inventor: Edwin E. Johnson, Colorado Springs, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 298 days.

(21) Appl. No.: 12/955,379

(22) Filed: Nov. 29, 2010

(65) Prior Publication Data

US 2012/0133260 A1 May 31, 2012

(51) Int. Cl.
*A47B 95/00* (2006.01)

(52) U.S. Cl.
USPC ..... 312/333; 312/334.44

(58) Field of Classification Search ..... 312/332.1, 312/333, 33.44, 334.45, 334.46, 334.47, 312/221, 222; 292/1, 15, 23, 194, DIG. 65, 292/140, 169; 109/19, 68; 232/1 E, 43.4, 232/44; 220/476; 49/68; 70/78, 79, 80, 70/81, 82, 83, 84, 85, 86, 87
See application file for complete search history.

(56) References Cited

U.S. PATENT DOCUMENTS 221,464 A * 11/1879 Hull ..... 70/86
2,064,926 A * 12/1936 Kuebler ..... 62/382
3,302,871 A * 2/1967 Kettering et al. ..... 232/43.4
5,199,774 A * 4/1993 Hedinger et al. ..... 312/219
5,303,994 A * 4/1994 Elsholz ..... 312/221
5,730,514 A 3/1998 Hashemi
5,757,109 A * 5/1998 Parvin ..... 312/334.11
6,450,596 B1 * 9/2002 Lee ..... 312/217
6,935,710 B2 8/2005 Chen et al.
7,261,329 B1 8/2007 Julian et al.
7,318,532 B1 1/2008 Lee et al.
7,357,468 B2 4/2008 Hwang et al.
7,448,704 B2 11/2008 Lam et al.
7,513,582 B2 4/2009 Yoon et al.
2004/0100166 A1 * 5/2004 Hoffman ..... 312/219
2008/0074017 A1 * 3/2008 Ruan et al. ..... 312/221
2008/0141496 A1 * 6/2008 Peng et al. ..... 16/94 R
2009/0160298 A1 * 6/2009 Chen et al. ..... 312/333

* cited by examiner

*Primary Examiner* — James O Hansen
*Assistant Examiner* — Sasha T Varghese
(74) *Attorney, Agent, or Firm* — Ronald E. Prass, Jr.; Prass LLP

(57) ABSTRACT

A latch system for a sliding member and a stationary member has upper and lower bodies fixed to the sliding member; an anchor block fixed to the stationary member; a release body slidably connected to the anchor block such that the release body can move relative to the anchor block; a lower arm having a first end and a second end, the first end of the lower arm being attached to the release body; a control arm having a first end and a second end, the first end of the control arm being rotatably attached to the second end of the lower arm; and a swivel cam having a first end and a second end, the first end of the swivel cam being rotatably attached to the second end of the control arm. When the sliding member is in a closed position and the release body is in a normal position, force exerted on the sliding member in an opening direction causes the second end of the swivel cam to engage a closed position detent on the upper body and causes the release body to push against a surface of the lower body, such that the upper body is prevented from moving in the opening direction.

20 Claims, 7 Drawing Sheets

APPARATUS FOR LATCHING A DRAWER USING A CAM LATCH

BACKGROUND OF THE DISCLOSURE

1. Field of the Disclosure

The disclosure relates to mechanisms for latching a drawer or other sliding body.

2. Introduction

Various cabinets have a drawer that can be latched so that the drawer stays in a closed position. However, in certain environments, such as, for example, military environments, a cabinet can be subjected to significant forces that can overcome the holding capability of the latch system of the cabinet. An example of such a force is the force resulting from impacts and/or explosions in battle. Conventional drawer latching systems either lack the strength to withstand such forces or are too large and cumbersome to be used on a compact cabinet or drawer.

SUMMARY OF THE DISCLOSED EMBODIMENTS

An apparatus for latching a drawer using a cam latch is disclosed. The apparatus may include a cabinet having a cabinet body, a drawer, and a releasable latch system for releasably preventing motion between the drawer and cabinet body. The drawer has open and closed positions relative to the cabinet body, the drawer is movable in an opening direction from the closed position to the open position, and the drawer is movable in a closing direction from the open position to the closed position. The latch system may have an upper body fixed to the drawer, the upper body having an open position detent and a closed position detent; a lower body fixed to the drawer; an anchor block fixed to the cabinet body; a release body slidably connected to the anchor block such that the release body can move relative to the anchor block between a normal position and a release position; a lower arm having a first end and a second end, the first end of the lower arm being attached to the release body; a control arm having a first end and a second end, the first end of the control arm being rotatably attached to the second end of the lower arm; and a swivel cam having a first end and a second end, the first end of the swivel cam being rotatably attached to the second end of the control arm. When the drawer is in the closed position and the release body is in the normal position, force exerted on the drawer in the opening direction causes the second end of the swivel cam to engage the closed position detent and causes the first end of the control arm or a body attached to the first end of the control arm to push against a surface of the lower body, such that the upper body is prevented from moving in the opening direction.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION OF THE DISCLOSURE

Figure 1:
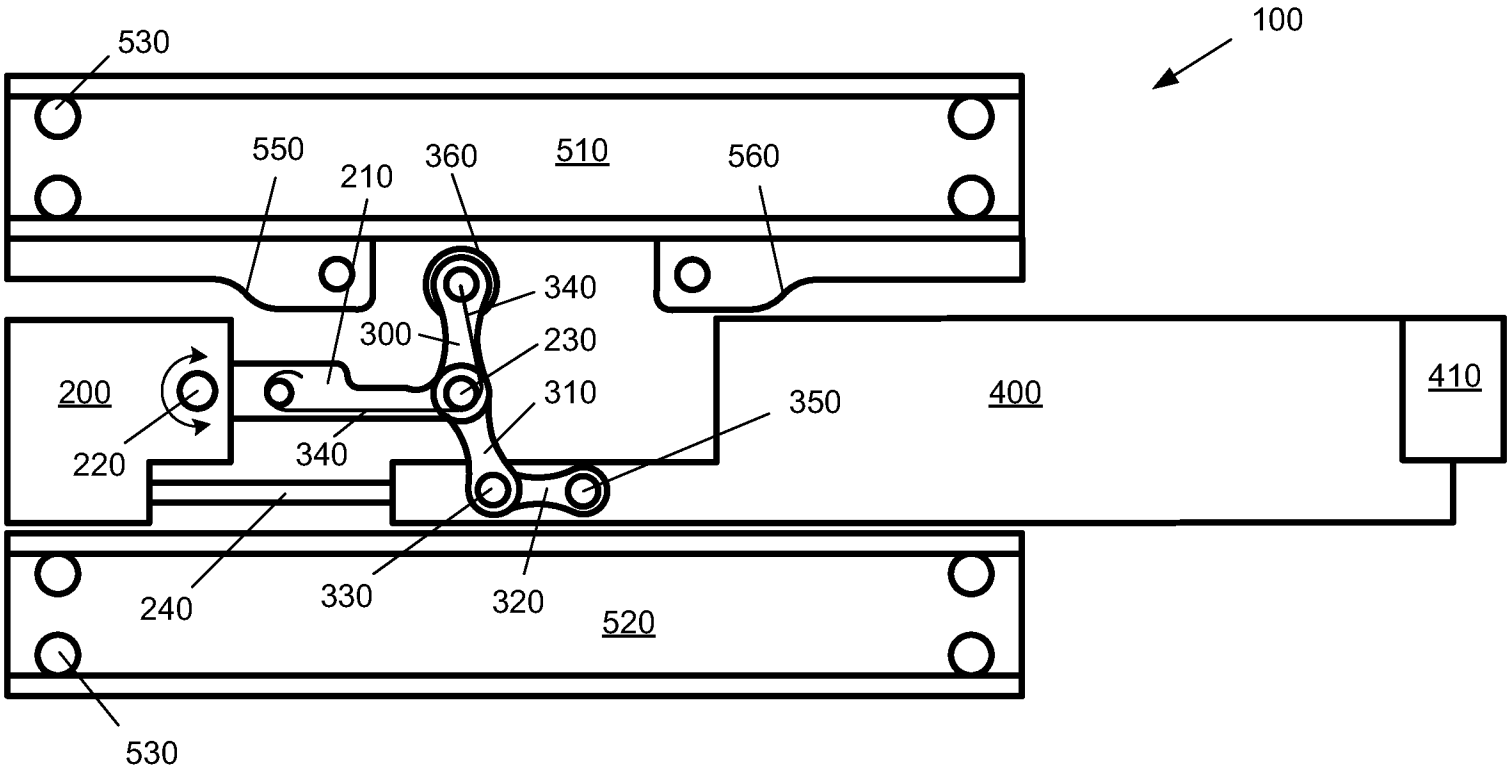
FIG. 1 illustrates a sliding position of an exemplary latching system in accordance with a possible embodiment of the disclosure.

Additional features and advantages of the disclosure will be set forth in the description which follows, and in part will be obvious from the description, or may be learned by practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth herein.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The disclosure comprises a variety of embodiments, such as a method and apparatus and other embodiments that relate to the basic concepts of the disclosure. This disclosure concerns a method and apparatus for releasably latching a sliding member, such as, for example, a drawer, to a stationary member, such as, for example, a cabinet.

FIGS. 1-7 show examples of latching systems in accordance with embodiments of the disclosure. In the figures, a latching mechanism 100 has an upper body 510 and a lower body 520 fixed to a sliding member, such as, for example, a drawer 610 in a cabinet 600. An example of body 510 and lower body 520 is upper and lower drawer rails that are fixed to a drawer. For simplicity, from this point forward the sliding member will be referred to as the drawer. Upper body 510 and lower body 520 have a plurality of fasteners 530 that fix upper body 510 and lower body 520 to the drawer. Upper body 510 has an open position detent 550 and a closed position detent 560 that provide surfaces against which other portions (discussed below) of the latching mechanism bear in a latched open position and a latched closed position, respectively.

The remaining elements shown in the figures are attached to the stationary member and do not move with the drawer. For simplicity, from this point forward the stationary member will be referred to as the cabinet. An anchor block 200 is fixed to the cabinet. A release body 400 is slidably attached to anchor block 200 by a rod 240 such that release body 400 can slide (horizontally in the figures) relative to anchor block 200, and therefore the cabinet. A spring or other urging member (not shown) can be provided between anchor block 200 and release body 400 such that they are urged apart from each other. A release button 410 is attached to release body 400 to provide a button which can be pressed by a user in order to move release body 400 and release the latch mechanism (described below).

A lower arm 320 has a first end and a second end. The first end of lower arm 320 can be fixed to or pivotably attached to release body 400 by a pin 350 that is fixed to release body 400. In the embodiment shown in FIG. 2, lower arm 320 is fixed to release body 400 and does not pivot relative to release body 400. In the embodiment shown in FIGS. 3-6, the first end of lower arm 320 is pivotably attached to release body 400 by pin 350. In both embodiments, the second end of lower arm 320 is pivotably attached to a first end of a control arm 310 by a pin 330 such that control arm 310 can pivot around pin 330 relative to lower arm 320. A second end of control arm 310 is pivotably attached to a first end of a swivel cam 300 at a cam attachment point 230. Cam attachment point 230 is a pin connection to a pivot arm 210. Both swivel cam 300 and control arm 310 can pivot relative to each other and relative to pivot arm 210.

Pivot arm 210 is, in this example, attached to anchor block 200 at a pivot point 220 such that pivot arm 210 can pivot relative to anchor block 200. In other embodiments, pivot arm 210 can be fixed to anchor block 200 but is flexible to allow cam attachment point 230 to move vertically in the figures.

In this example, swivel cam 300 has at its second end a roller 360 that facilitates movement of the second end of swivel cam 300 over open position detent 550 and closed position detent 560. Other embodiments may not have such a roller and may provide smooth movement of the second end of swivel cam 300 over open position detent 550 and closed position detent 560 by other means such as, for example, particular materials or lubricants. This embodiment also provides a spring 340 that holds swivel cam 300 in a substantially vertical position when the second end of swivel cam 300 is not interacting with any other element of the system (such as, for example, open position detent 550 or closed position detent 560).

The operation of the system will now be discussed. FIG. 1 shows the system in a sliding position in which the drawer can be moved between a closed position and an open position. The distance between open position detent 550 and closed position detent 560 roughly corresponds to the travel of the drawer and would be greater than that shown in the figures. In the sliding position shown in FIG. 1, swivel cam 300 is held in the substantially vertical position by spring 340. In this position, the second end of swivel cam 300 preferably does not touch any part of upper body 510.

Figure 2:
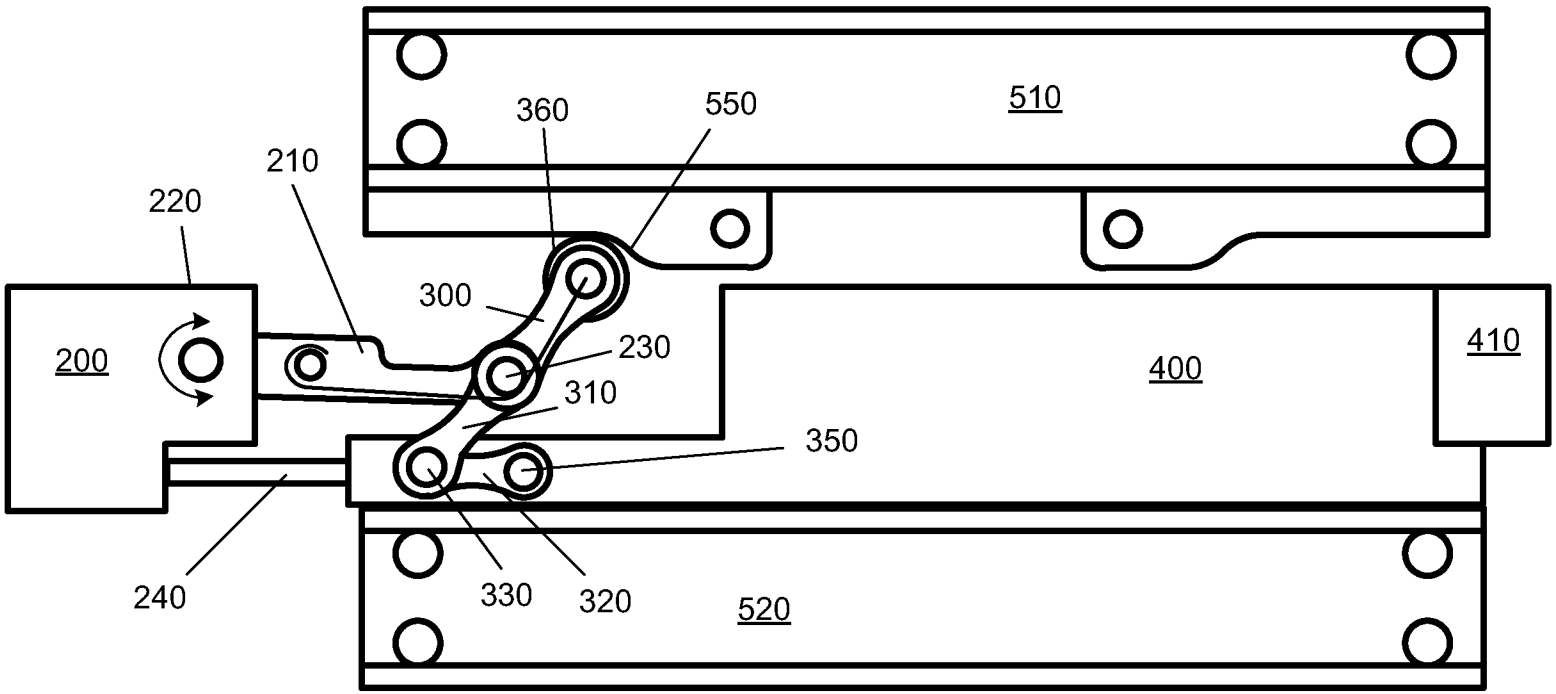
FIG. 2 illustrates a first embodiment of the disclosure in a latched open position.
Figure 3:
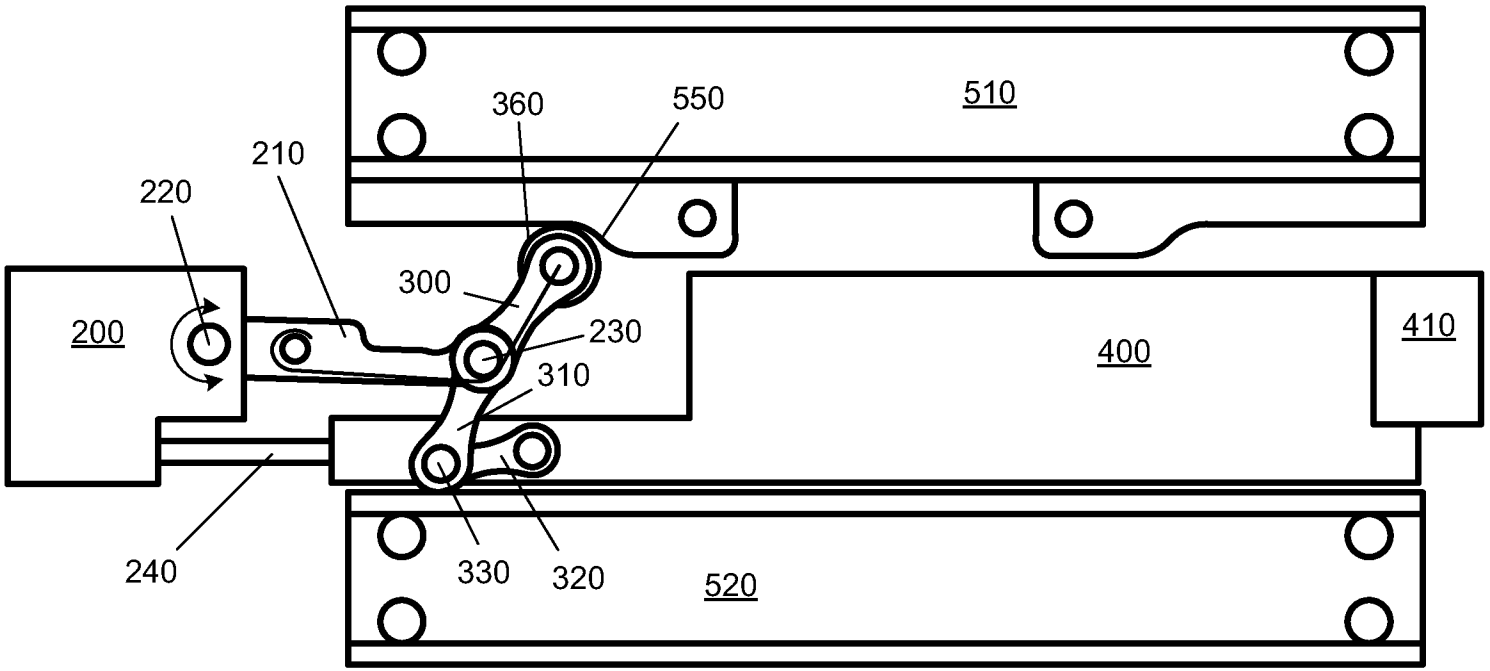
FIG. 3 illustrates a second embodiment of the disclosure in a latched open position.

If the drawer (and thus upper body 510 and lower body 520) is moved to the right in FIG. 1, the system moves into the position shown in FIG. 2 or FIG. 3 (depending on the embodiment), which is the latched open position. In moving from the sliding position (FIG. 1) to the latched open position (FIG. 2 or FIG. 3), roller 360 has traveled down and under open position detent 550.

Once in the latched open position, any attempt to move the drawer to the left in FIG. 2 or FIG. 3 results in roller 360 pressing against open position detent 550. The downward force exerted on swivel cam 300 is transferred through cam attachment point 230 to control arm 310 and then to an upper surface of lower body 520.

Because pivot arm 210 prevents cam attachment point 230 from moving to the left in FIG. 2 and FIG. 3, a rigid lever arm is formed by swivel cam 300 and control arm 310 that prevents the drawer from moving to the left in FIG. 2 and FIG. 3. In this example, pivot arm 210 is in compression.

In the embodiment shown in FIG. 2, where lower arm 320 is fixed to release body 400 at pin 330 and does not pivot relative to release body 400, the downward force exerted on swivel cam 300 is transferred through cam attachment point 230 to control arm 310, then to release body 400 through pin 330, and then to an upper surface of lower body 520. This embodiment uses a large area (some or all of a lower surface of release body 400) to transmit the force to lower body 520. In the position shown in FIG. 1, the space between release body 400 and lower body 520 is relatively small in order to permit release body 400 to contact lower body 520 when the mechanism is in the position shown in FIG. 2 and force is exerted on the drawer in a closing direction.

In the embodiment shown in FIG. 3, the downward force exerted on swivel cam 300 is transferred through cam attachment point 230 to control arm 310 and then directly to the upper surface of lower body 520. Note that the lower end (first end) of control arm 310 has moved downward in FIG. 3 as compared to FIG. 1. This embodiment uses a relatively small area (the lower end of control arm 310) to transmit the force to lower body 520.

For clarity, the further operation of the mechanism will be explained with reference to the embodiment shown in FIG. 3. The same mechanical principals apply to the embodiment shown in FIG. 2. The difference between the embodiments shown in FIGS. 2 and 3 is the contact point between the cabinet and the drawer in the latched open position (and also the latched closed position).

Figure 4:
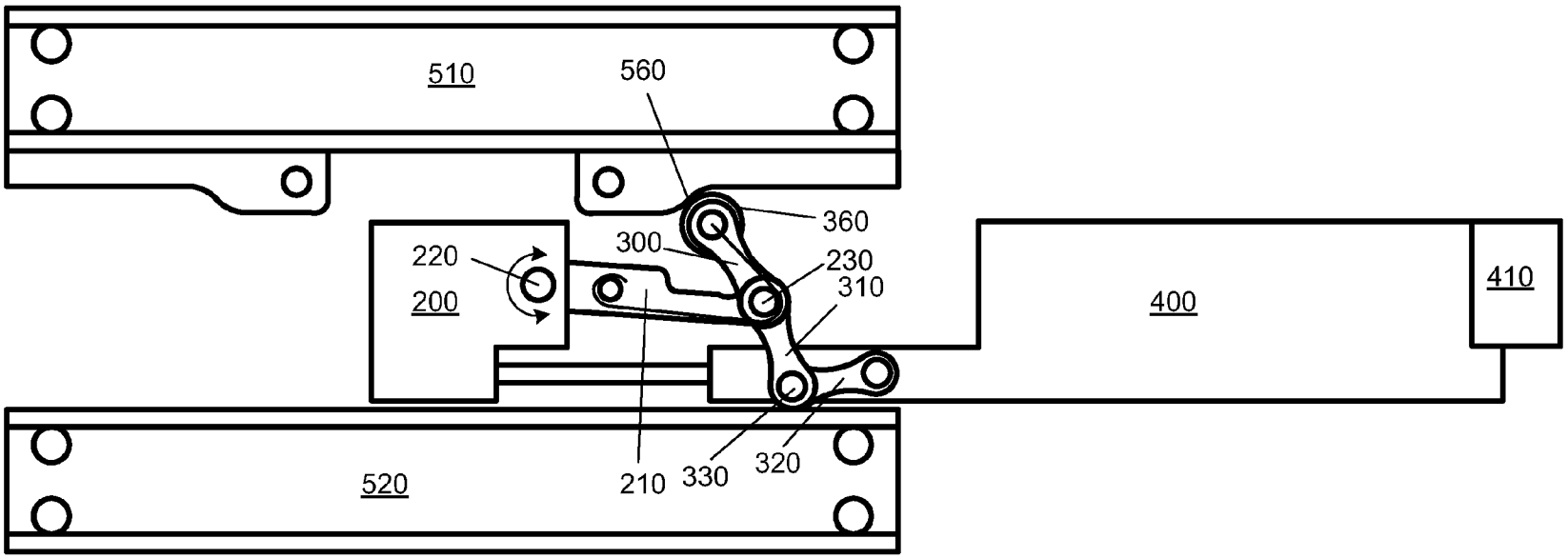
FIG. 4 illustrates the second embodiment of the disclosure in a latched closed position.

FIG. 4 shows the system in the latched closed position. This position is similar to the latched open position shown in FIG. 3, except that roller 360 is pressed against closed position detent 560 instead open position detent 550. The same mechanics that apply to the position shown in FIG. 3 apply to the position shown in FIG. 4. In this example, pivot arm 210 is in tension in the position shown in FIG. 4.

Figure 5:
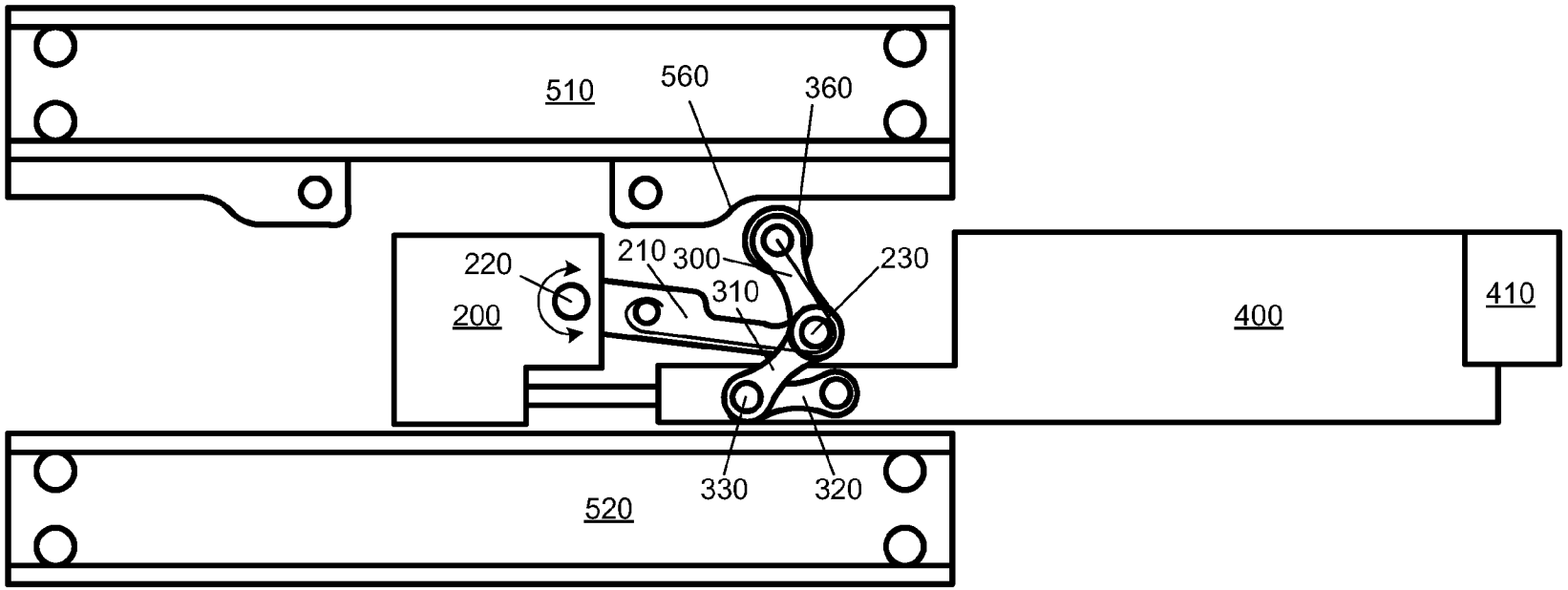
FIG. 5 illustrates the second embodiment of the disclosure in a position after being released from a latched closed position.
Figure 6:
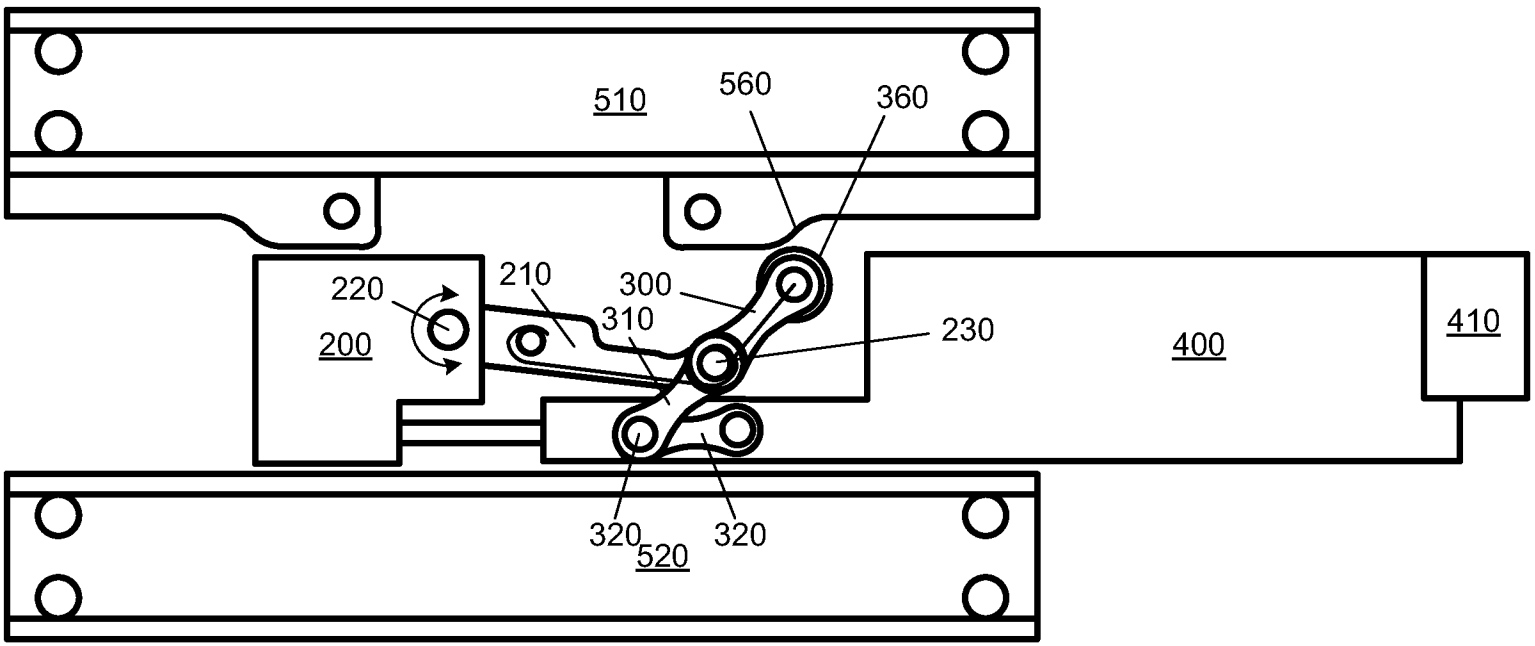
FIG. 6 illustrates the second embodiment of the disclosure in an opening position.
Figure 7:
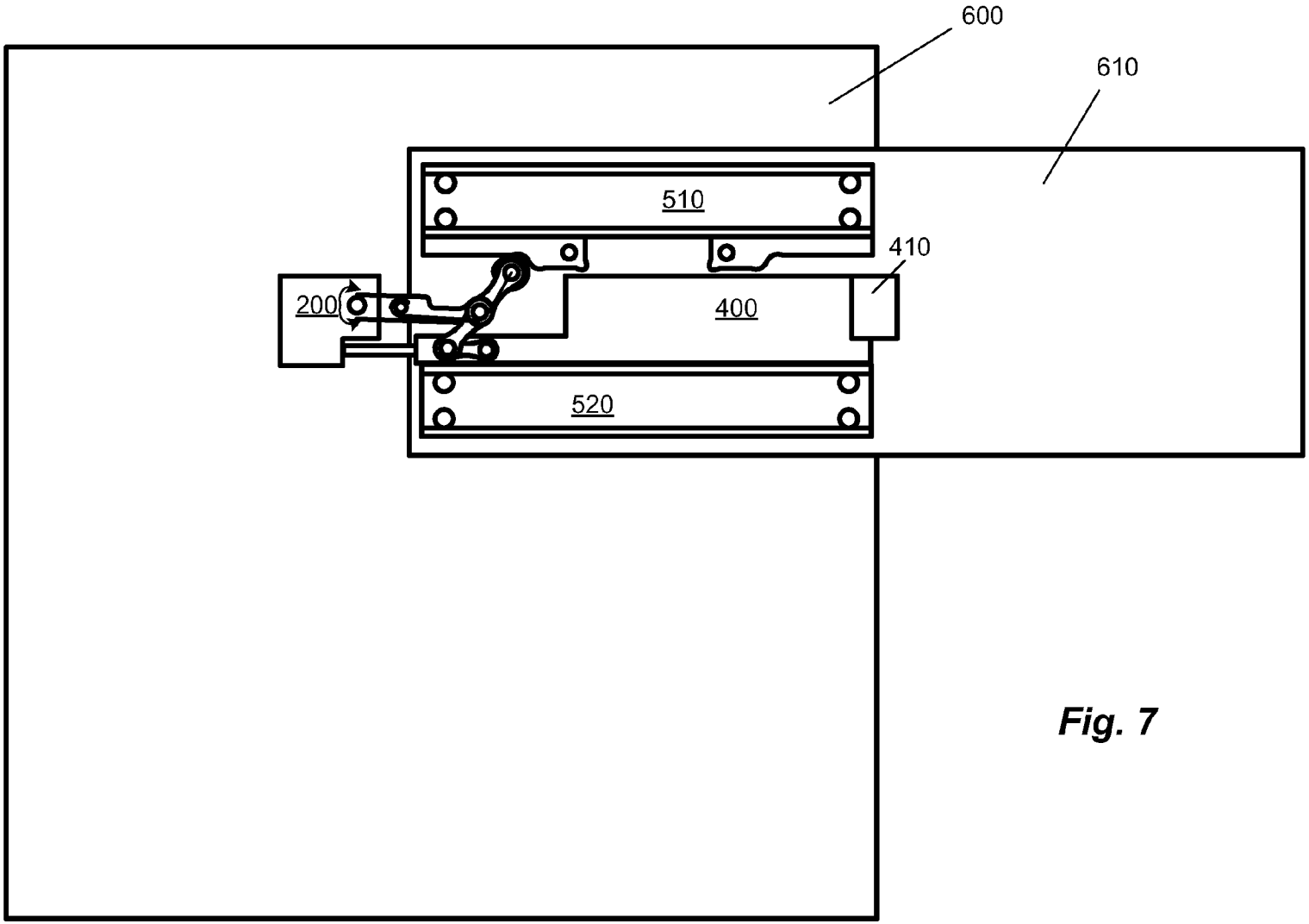
FIG. 7 illustrates an embodiment of the disclosure in an open position.

FIG. 5 shows how the mechanism breaks the rigid level arm that is formed by swivel cam 300 and control arm 310 in the latched closed position of FIG. 4. In FIG. 5, pin 330 is moved to the left (relative to anchor block 200) by pushing release button 410. Pushing release button 410 moves release body 400 to the left relative to anchor block 200 by compressing the spring (not shown) that urges release body 400 and anchor block 200 apart. This moves the lower end (first end) of control arm 310 to the left and upward away from the upper surface of lower body 520 because the upper end (second end) of control arm 310 is prevented from moving to the left by pivot arm 210. This moves cam attachment point 230 downward, which moves roller 360 away from closed position detent 560. Movement of the drawer to the right (opening the drawer) will cause swivel cam 300 to flop over as shown in FIG. 6. Further movement of the drawer to the right will result in the position shown in FIG. 1, at which the draw can continue to be opened until the latched open position shown in FIG. 3 is reached.

In particular embodiments, release body 400 and anchor block 200 will stay in the compressed relationship (the release position) while the mechanism is in the position shown in FIG. 1. As roller 360 moves under either open position detent 550 or closed position detent 560, release body 400 will move out of the release position and back into the normal position.

Although the above description may contain specific details, they should not be construed as limiting the claims in any way. Other configurations of the described embodiments of the disclosure are part of the scope of this disclosure. For example, the principles of the disclosure may be applied to each individual user where each user may individually deploy such a system. This enables each user to utilize the benefits of the disclosure even if any one of the large number of possible applications do not need the functionality described herein. In other words, there may be multiple instances of the components in the disclosed embodiments each processing the content in various possible ways. It does not necessarily need to be one system used by all end users. Accordingly, the appended claims and their legal equivalents should only define the disclosure, rather than any specific examples given.

I claim:

1. A releasable latch system for releasably preventing motion between a sliding member and a stationary member, the sliding member having open and closed positions relative to the stationary member, the sliding member being movable in an opening direction from the closed position to the open position, and the sliding member being movable in a closing direction from the open position to the closed position, the system comprising:

an upper body fixed to the sliding member, the upper body having an open position detent and a closed position detent;

a lower body fixed to the sliding member;

an anchor block fixed to the stationary member;

a release body slidably connected to the anchor block such that the release body can move relative to the anchor block between a normal position and a release position;

a lower arm having a first end and a second end, the first end of the lower arm being attached to the release body;

a control arm having a first end and a second end, the first end of the control arm being rotatably attached to the second end of the lower arm; and a swivel cam having a first end and a second end, the first end of the swivel cam being rotatably attached to the second end of the control arm, wherein when the sliding member is in the closed position and the release body is in the normal position, force exerted on the sliding member in the opening direction causes the second end of the swivel cam to engage the closed position detent and causes the release body to push against a surface of the lower body, such that the upper body is prevented from moving in the opening direction.

2. The system of claim 1, wherein when the sliding member is in the closed position and the release body is in the release position, force exerted on the sliding member in the opening direction causes the swivel cam to rotate to a position in which the second end of the swivel cam passes by the closed position detent such that the upper body is permitted to move in the opening direction.

3. The system of claim 2, wherein when the sliding member is in the open position and the release body is in the normal position, force exerted on the sliding member in the closing direction causes the second end of the swivel cam to engage the open position detent and causes the release body to push against a surface of the lower body, such that the upper body is prevented from moving in the closing direction.

4. The system of claim 2, further comprising a holding member having a first end and a second end, the first end of the holding member being attached to the anchor block, and the second end of the holding member being rotatably attached to the second end of the control arm.

5. The system of claim 4, wherein the first end of the holding member is pivotably attached to the anchor block.

6. The system of claim 2, further comprising a spring that urges the second end of the swivel cam into a position that is substantially vertical relative to the first end of the swivel cam.

7. The system of claim 2, further comprising a rod having a first end and a second end, the first end being fixed to one of the anchor block and the release body, and the second end being slidably attached to the other of the anchor block and the release body.

8. The system of claim 7, further comprising an urging member associated with the rod such that the anchor block and the release body are urged in opposite directions by the urging member, and movement of the release body from the normal position to the release position is counteracted by the urging member.

9. The system of claim 2, wherein the upper body is an upper rail of a drawer, and the lower body is a lower rail of the drawer.

10. A releasable latch system for releasably preventing motion between a sliding member and a stationary member, the sliding member having open and closed positions relative to the stationary member, the sliding member being movable in an opening direction from the closed position to the open position, and the sliding member being movable in a closing direction from the open position to the closed position, the system comprising:

an upper body fixed to the sliding member, the upper body having an open position detent and a closed position detent;

a lower body fixed to the sliding member;

an anchor block fixed to the stationary member;

a release body slidably connected to the anchor block such that the release body can move relative to the anchor block between a normal position and a release position;

a lower arm having a first end and a second end, the first end of the lower arm being attached to the release body;

a control arm having a first end and a second end, the first end of the control arm being rotatably attached to the second end of the lower arm; and a swivel cam having a first end and a second end, the first end of the swivel cam being rotatably attached to the second end of the control arm, wherein when the sliding member is in the closed position and the release body is in the normal position, force exerted on the sliding member in the opening direction causes the second end of the swivel cam to engage the closed position detent and causes the first end of the control arm to push against a surface of the lower body, such that the upper body is prevented from moving in the opening direction.

11. The system of claim 10, wherein when the sliding member is in the closed position and the release body is in the release position, force exerted on the sliding member in the opening direction causes the swivel cam to rotate to a position in which the second end of the swivel cam passes by the closed position detent such that the upper body is permitted to move in the opening direction.

12. The system of claim 11, wherein when the sliding member is in the open position and the release body is in the normal position, force exerted on the sliding member in the closing direction causes the second end of the swivel cam to engage the open position detent and causes the first end of the control arm to push against a surface of the lower body, such that the upper body is prevented from moving in the closing direction.

13. The system of claim 11, further comprising a holding member having a first end and a second end, the first end of the holding member being attached to the anchor block, and the second end of the holding member being rotatably attached to the second end of the control arm.

14. The system of claim 13, wherein the first end of the holding member is pivotably attached to the anchor block.

15. The system of claim 11, further comprising a spring that urges the second end of the swivel cam into a position that is substantially vertical relative to the first end of the swivel cam.

16. The system of claim 11, further comprising a rod having a first end and a second end, the first end being fixed to one of the anchor block and the release body, and the second end being slidably attached to the other of the anchor block and the release body.

17. The system of claim 16, further comprising an urging member associated with the rod such that the anchor block and the release body are urged in opposite directions by the urging member, and movement of the release body from the normal position to the release position is counteracted by the urging member.

18. The system of claim 11, wherein the upper body is an upper rail of a drawer, and the lower body is a lower rail of the drawer.

19. A cabinet comprising:

a cabinet body;

a drawer having open and closed positions relative to the cabinet body, the drawer being movable in an opening direction from the closed position to the open position, and the drawer being movable in a closing direction from the open position to the closed position; and a releasable latch system for releasably preventing motion between the drawer and cabinet body, the latch system having an upper body fixed to the drawer, the upper body having an open position detent and a closed position detent;

a lower body fixed to the drawer;

an anchor block fixed to the cabinet body;

a release body slidably connected to the anchor block such that the release body can move relative to the anchor block between a normal position and a release position;

a lower arm having a first end and a second end, the first end of the lower arm being attached to the release body;

a control arm having a first end and a second end, the first end of the control arm being rotatably attached to the second end of the lower arm; and a swivel cam having a first end and a second end, the first end of the swivel cam being rotatably attached to the second end of the control arm, wherein when the drawer is in the closed position and the release body is in the normal position, force exerted on the drawer in the opening direction causes the second end of the swivel cam to engage the closed position detent and causes the release body to push against a surface of the lower body, such that the upper body is prevented from moving in the opening direction.

20. The cabinet of claim 19, wherein when the drawer is in the closed position and the release body is in the release position, force exerted on the drawer in the opening direction causes the swivel cam to rotate to a position in which the second end of the swivel cam passes by the closed position detent such that the upper body is permitted to move in the opening direction.

* * * * *